US008689717B2

(12) United States Patent
Benveniste et al.

(10) Patent No.: US 8,689,717 B2
(45) Date of Patent: Apr. 8, 2014

(54) EMERGENCY REPAIR PLUG TO SLOW DOWN WATER INFLOW THROUGH AN OPENING

(75) Inventors: Richard Joseph Benveniste, Valencia, CA (US); Henry Goldman, Valencia, CA (US); Joseph Fitzgerald, Bellingham, WA (US)

(73) Assignee: Artelier Studio LLC, Santa Clara, CA (US)

( * ) Notice: Subject to any disclaimer, the term of this patent is extended or adjusted under 35 U.S.C. 154(b) by 787 days.

(21) Appl. No.: 12/591,662

(22) Filed: Nov. 25, 2009

(65) Prior Publication Data

US 2010/0132605 A1 Jun. 3, 2010

Related U.S. Application Data

(60) Provisional application No. 61/200,118, filed on Nov. 25, 2008.

(51) Int. Cl.
*B63B 43/16* (2006.01)

(52) U.S. Cl.
USPC ..... 114/227

(58) Field of Classification Search
USPC ..... 114/227, 228, 229, 197, 182; 29/522.1; 215/200; 156/98; 220/212; 277/314
See application file for complete search history.

(56) References Cited

U.S. PATENT DOCUMENTS

| | | | | |
|---|---|---|---|---|
| 5,845 A | | 10/1848 | Seeley | |
| 729,835 A | | 6/1903 | Barnes et al. | |
| 2,321,515 A | | 6/1943 | Rice | |
| 2,476,601 A | | 5/1945 | Harper | |
| 3,432,139 A | | 3/1969 | Jentoft | |
| 3,794,029 A | | 2/1974 | Dulle | |
| 4,062,165 A | | 12/1977 | Marks et al. | |
| 4,067,759 A | | 1/1978 | Vrolyk et al. | |
| 4,329,132 A | | 5/1982 | Melvold et al. | |
| 4,552,137 A | | 11/1985 | Strauss | |
| 4,774,938 A | * | 10/1988 | Leight | 128/864 |
| 4,892,219 A | | 1/1990 | Smith | |
| 4,930,657 A | * | 6/1990 | Walker | 220/235 |
| 5,245,941 A | | 9/1993 | Gattuso | |

(Continued)

FOREIGN PATENT DOCUMENTS

GB 2432562 5/2007

OTHER PUBLICATIONS http://www4.whdh.com/news/articles/local/BO62527 "Sponge Bob football fills the gap in a sinking fishing vessel" dated Sep. 19, 2007.*

(Continued)

*Primary Examiner* — S. Joseph Morano
*Assistant Examiner* — Anthony Wiest
(74) *Attorney, Agent, or Firm* — Shlesinger Arkwright & Garvey LLP

(57) ABSTRACT

An emergency repair plug for sealing an opening in a boat hull, comprises a conical body made of a solid foam, spongy cellular material that is compressible by hand and able to return to its original shape. The conical body is compressible by hand to a smaller dimension so that a portion of the conical body larger than an opening to be plugged can be inserted into the opening. The conical body is able to return to its larger size after compression, thereby to be wedged in the opening to slow down water inflow through the opening.

13 Claims, 5 Drawing Sheets

(56) References Cited

U.S. PATENT DOCUMENTS

| | | | |
|---|---|---|---|
| 5,632,925 | A | 5/1997 | Moulton et al. |
| 6,189,573 | B1 | 2/2001 | Ziehm |
| 6,722,304 | B1 | 4/2004 | Conley |
| 7,490,629 | B2 | 2/2009 | Williams et al. |

OTHER PUBLICATIONS http://www.paddlerzone.co.nz/products/accessories/general_accessories/mission_kayaking_mushroom_bungs dated Oct. 14, 2011.*
"Internet Archive Wayback Machine" [online] [Retreived on Mar. 13, 2012]. Reterived From: http://web.archive.org/web/20050430223104/http://www.motivators.com/6143-promotional-item.html.*
"Motivators Promotional Products" [online] [retreived on Mar. 13, 2012]. Retreived From: http://www.motivators.com/Promotional-Custom-SafetyConeStressball-6143.html#Tab12.*
"7 News WHDH Boston" [Online] [Retreived on Mar. 13, 2012]. Retreived From: http://www4.whdh.com/news/articles/local/BO62527.*
Rubber hole plugs, http:www.estenterprises.com/rubber-hole-plugs.html? gclid=COuazuT305wCFRJD5godJxrHHg.

* cited by examiner

EMERGENCY REPAIR PLUG TO SLOW DOWN WATER INFLOW THROUGH AN OPENING

RELATED APPLICATION

This is a nonprovisional application claiming the benefit of provisional application Ser. No. 61/200,118, filed Nov. 25, 2008, hereby incorporated by reference.

FIELD OF THE INVENTION

The present invention relates generally to a device for plugging on a temporary and emergency basis an opening in a boat hull.

BACKGROUND OF THE INVENTION

All boats have many "through-hull fittings" which allow water to enter or exit a boat for various functions such as engine cooling, gray water drains, etc. The through-hull fittings typically have shutoff valves connected to a nipple and a hose. One reason for boats docked in harbor sinking is failure of one of these components. While at sea these components can also fail. In addition, the through-hull fitting has a lip on the outside of the hull and could break away upon an even slight direct impact or scraping, allowing the inward flow of water into the boat.

The current commercially available remedy for this are wood plugs that must be hammered in, using a mallet to lock the wood plug in place. Hammering wood plugs into the hull generally makes the hole larger. In inserting into a nipple, valve or fitting, the wood plug must also be hammered in place that can lead to a cracked nipple before the wood plug grabs enough of the fitting to stop the inward follow of water. The force needed to lock the wood plug in place could also split the nipple. The exact size of the wood taper plug is also needed for each through-hull fitting, or nipple.

SUMMARY OF THE INVENTION

The present invention provides an emergency repair plug for sealing an opening in a boat hull, comprising a conical body made of a solid foam, spongy cellular material that is compressible by hand and able to return to its original shape. The conical body is compressible by hand to a smaller dimension so that a portion of the conical body larger than an opening to be plugged can be inserted into the opening. The conical body is able to return to its larger size after compression, thereby to be wedged in the opening to slow down water inflow through the opening.

The present invention also provides a method for temporarily plugging an opening to stop water flow through the opening, comprising providing a conical shaped body made of hand-compressible solid foam, spongy material; compressing a portion of the conical body into a size small enough to fit in an opening to be plugged; inserting the compressed portion into the opening; and releasing the compressed portion within the opening, thereby allowing the compressed portion to be wedged in the opening to slow down water inflow through the opening.

DETAILED DESCRIPTION OF THE INVENTION

Figure 1:
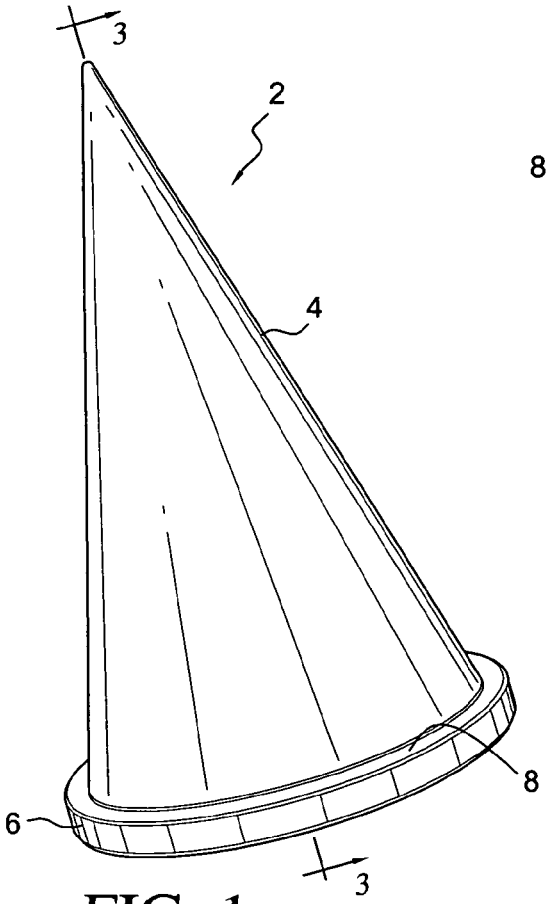
FIG. 1 is a top perspective view of an emergency repair plug embodying the present invention.
Figure 2:
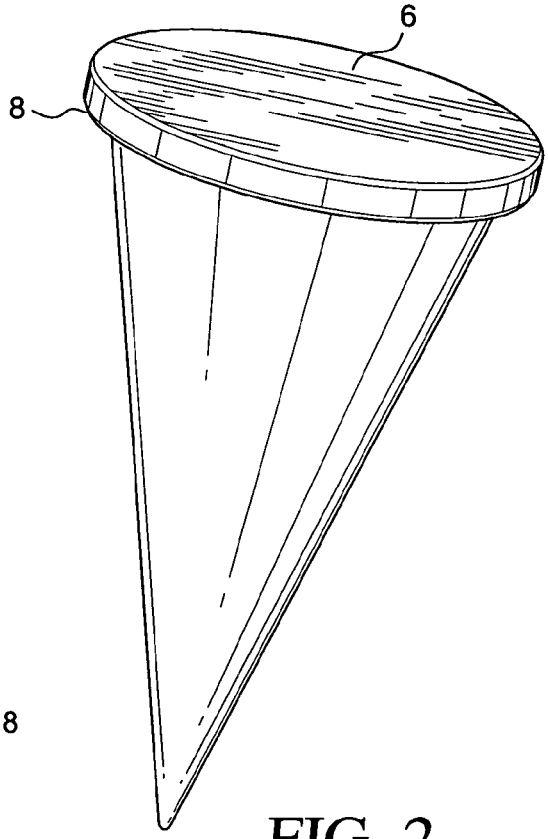
FIG. 2 is a bottom perspective view of FIG. 1.

Referring to FIGS. 1 and 2, an emergency repair plug 2 comprises a conical body 4 having a base flange 6. The flange 6 is preferably circular having a circumferential edge portion 8 that extends beyond the conical body 4. The conical body 4 advantageously provides an increasing cross-sectional area from the top to the flange 6 so that one plug may be used for different size openings. The flange 6 advantageously provides a handle grabable by a user's hand when inserting and twisting the plug into an opening to be plugged. The flange 6 also provides a defined portion that can be cut and separated from the body 4, as will be described below.

Figure 3:
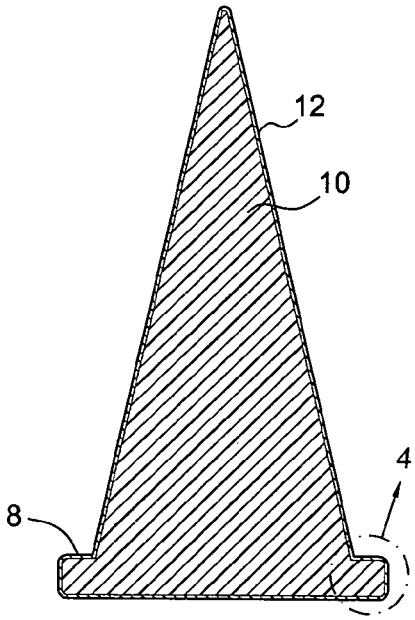
FIG. 3 is a cross-sectional view along line 3-3 of FIG. 1.
Figure 4:
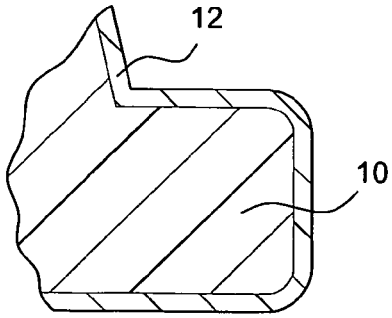
FIG. 4 is an enlarged portion taken from FIG. 3.

Referring to FIGS. 3 and 4, the plug 2 is made of a hand-compressible, solid foam, spongy cellular material 10 coated with a flexible sealer 12 to protect the material 10 and provide color. An example of the material 10 is polyurethane flexible foam having the composition by weight of about 60% polyether, about 31% MDI (methylene diphenyl diisocyanate and about 9% colorants. An example of the flexible sealer 12 is by weight about 30% organic pigment, about 50% resin, about 10% additive and about 10% stabilizer. The material 10 and the sealer 12 are conventional and in the market, such as, for example, from Bomex Chemical (Shanghai) Co. Ltd., Building C-1 & 2 No. 108 Hualei Road, Xin Qiao County, Songjiang District, Shanghai, P.R. China 201612 (www.bomexchem.com).

Figure 5:
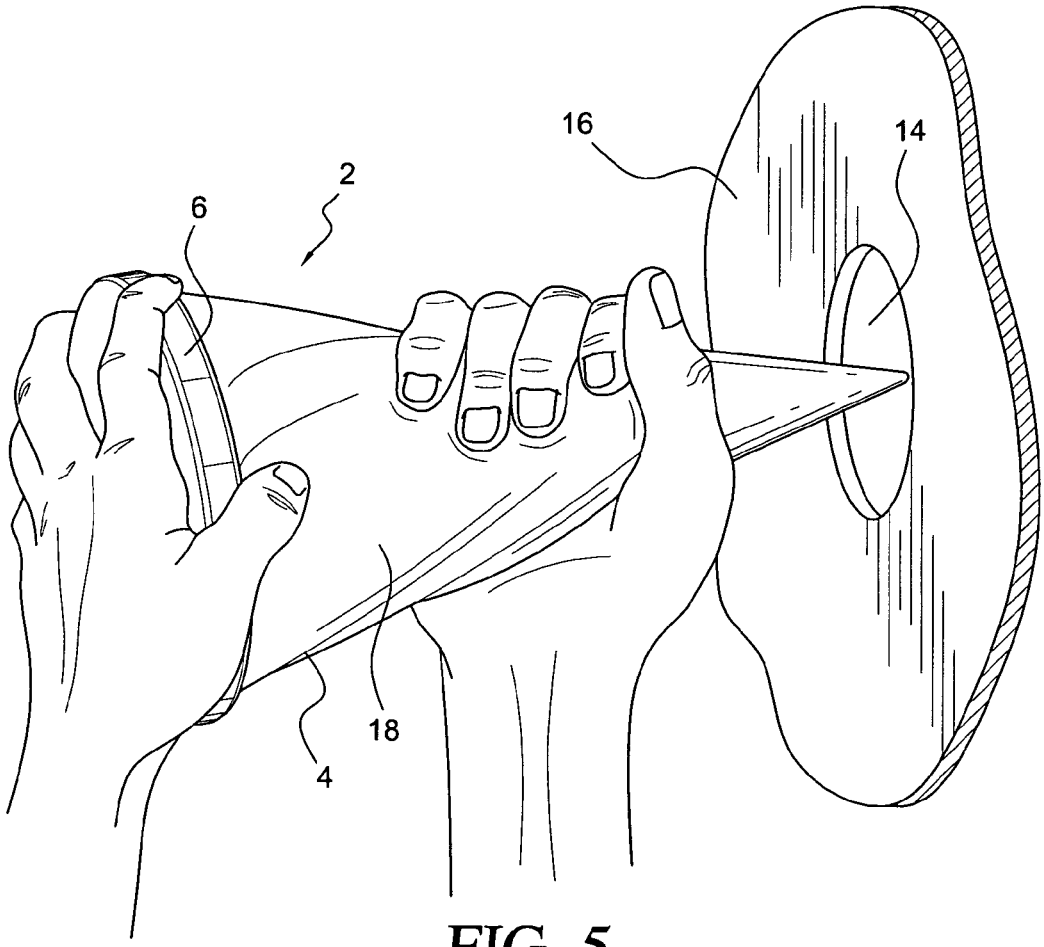
FIG. 5 shows the plug 2 being compressed by hand prior to insertion into an opening.
Figure 6:
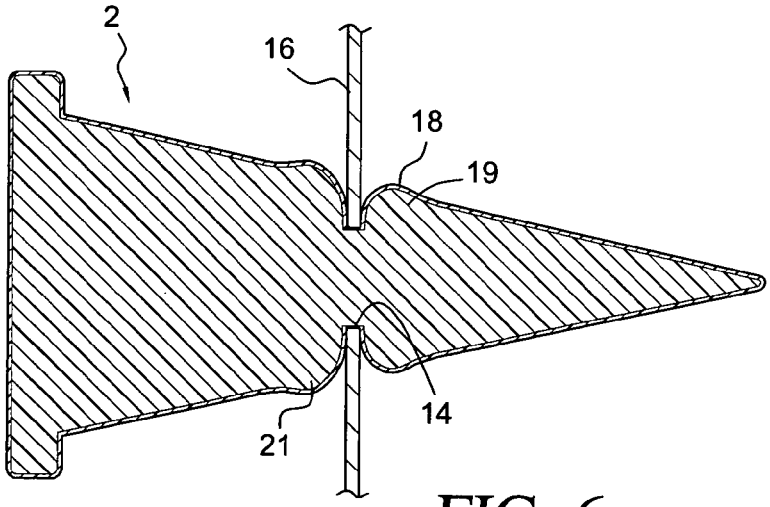
FIG. 6 is a cross-section view of the plug of FIG. 5 after being inserted into an opening.

Referring to FIG. 5, the plug 2 is advantageously sized to be conveniently handled by the user using only his hands. The plug 2 is used to completely or partly close an opening 14, for example in a boat hull 16, caused by an accident or failure of a through-hull fitting. In use, the conical body 4 is compressed by one hand and preferably twisted by the other hand by grabbing the flange 6 prior to being inserted into the opening 14. An intermediate portion 18 of the conical body 4 having a cross-sectional area larger than the opening 14 is compressed and then inserted into the opening 14. The conical body 4 is then released inside the opening. Since the plug 2 is made of solid foam spongy material, the plug 2 will expand to return to its original shape after being released in the opening 14, thereby getting wedged in the opening, as shown in FIG. 6. Due to the compressed portion 18 expanding after release, shoulders 19 and 21 will form outside the opening 14 to anchor the plug 2 to the hull 16. Water flow into the boat will be stopped or slowed down to permit the boat bilge pump to handle the reduced inflow of water and thereby keep the boat afloat until permanent repairs can be made.

The plug 2 is not intended to completely stop the inflow of water through the opening 14. Rather, the plug 2 is intended to cover as much of the opening 14 as possible to slow down the inflow of water. If necessary, more than one plug 2 may used and forced into the opening 14. The base flange 6 provides a convenient handle for the user to push and twist the plug 2 into the opening 14. The shoulder 21 immediately outside the opening may be compressed in order to push the body 4 further into the opening 14, thereby to close more of the opening.

Figure 7:
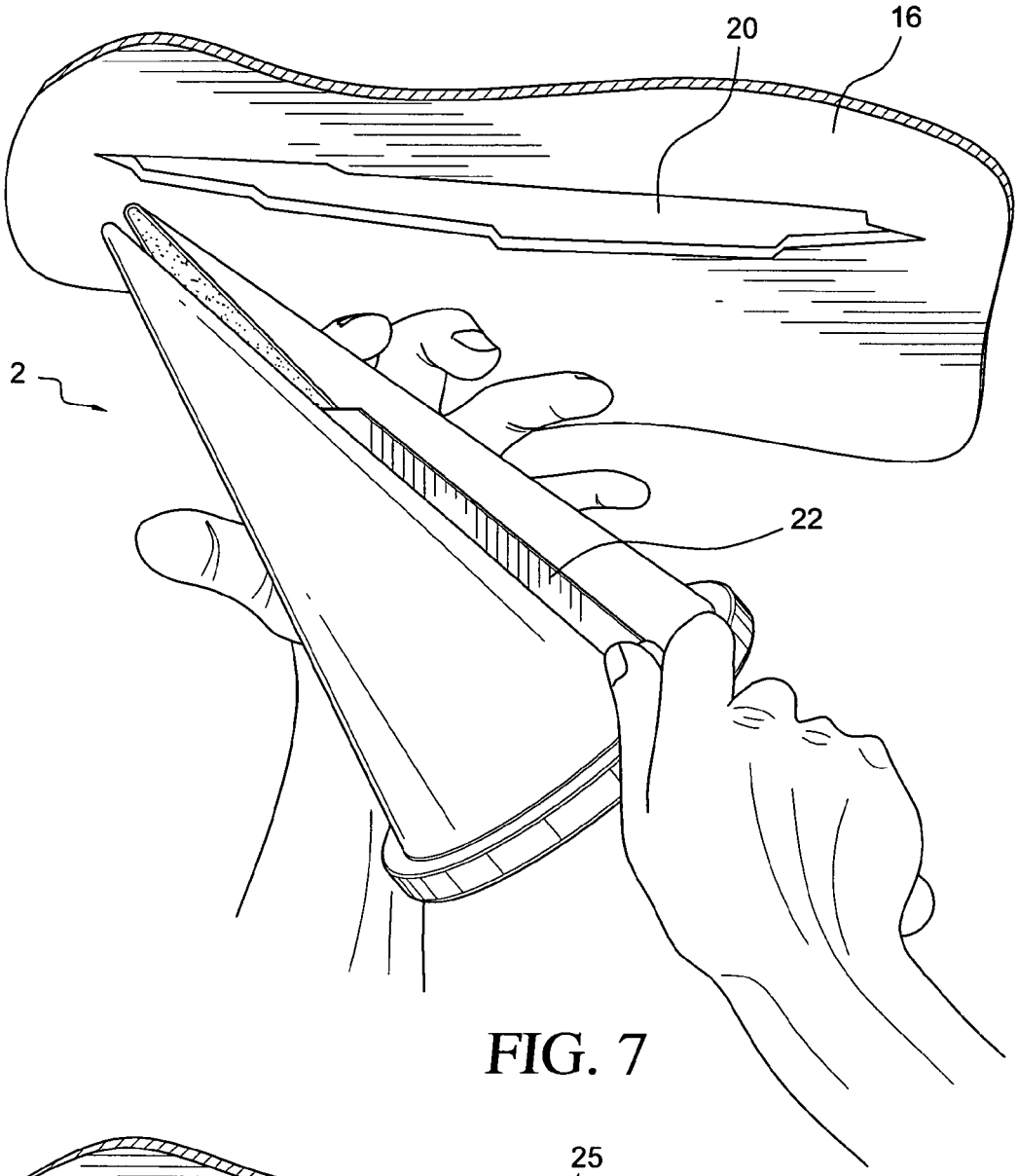
FIG. 7 shows the plug of FIG. 1 being cut in half longitudinally to plug a longitudinal opening.
Figure 8:
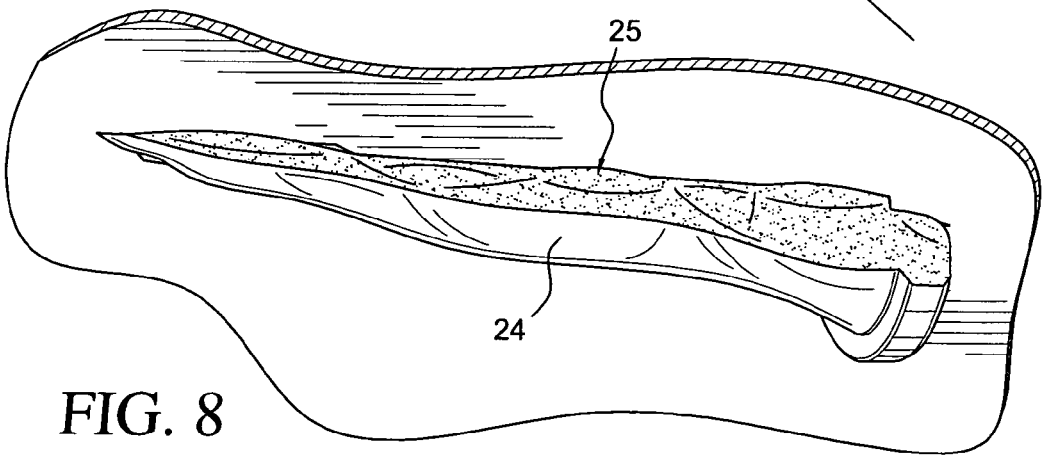
FIG. 8 shows the cut portion of the plug of FIG. 7 after being inserted into the opening.

Although the opening 14 is shown to be circular or oval, the plug 2 may also used to plug an irregular shaped hole. Referring to FIGS. 7 and 8, where an opening 20 in the hull 16 is longitudinal with an irregular shape, the plug 2 may be cut to a size appropriate for wedging in the opening. For example, the plug 2 is shown being cut in half longitudinally, using a knife 22 or any hand cutting tool. The cut portion 24 is then pressed by hand into the opening 20, using one's fingers to push the portion 24 in the opening. Since the material 10 is compressible by hand, the cut portion 24 can be forced into the opening 20 by hand, without the danger of enlarging the opening 20. If necessary, a blunt tool, such as a spatula, may be used to push the cut portion into the opening 20. Due to the compressibility of the plug 2, and its ability to spring or return back to its original shape, the cut portion 24 will become wedged in the opening 20 and slow down the inflow of water. Similarly to FIG. 6, the cut portion 24 outside the opening would form shoulders 25 beyond the periphery of the opening to press against the hull 16, thereby locking the cut portion in place. The irregular edges of the opening 20 will also bite into the cut portion 24 to further keep the plug in place. If necessary, another plug 2, or other pieces cut from the plug may be used to plug other portions of the opening 20 not covered by the cut portion 24.

Figure 9:
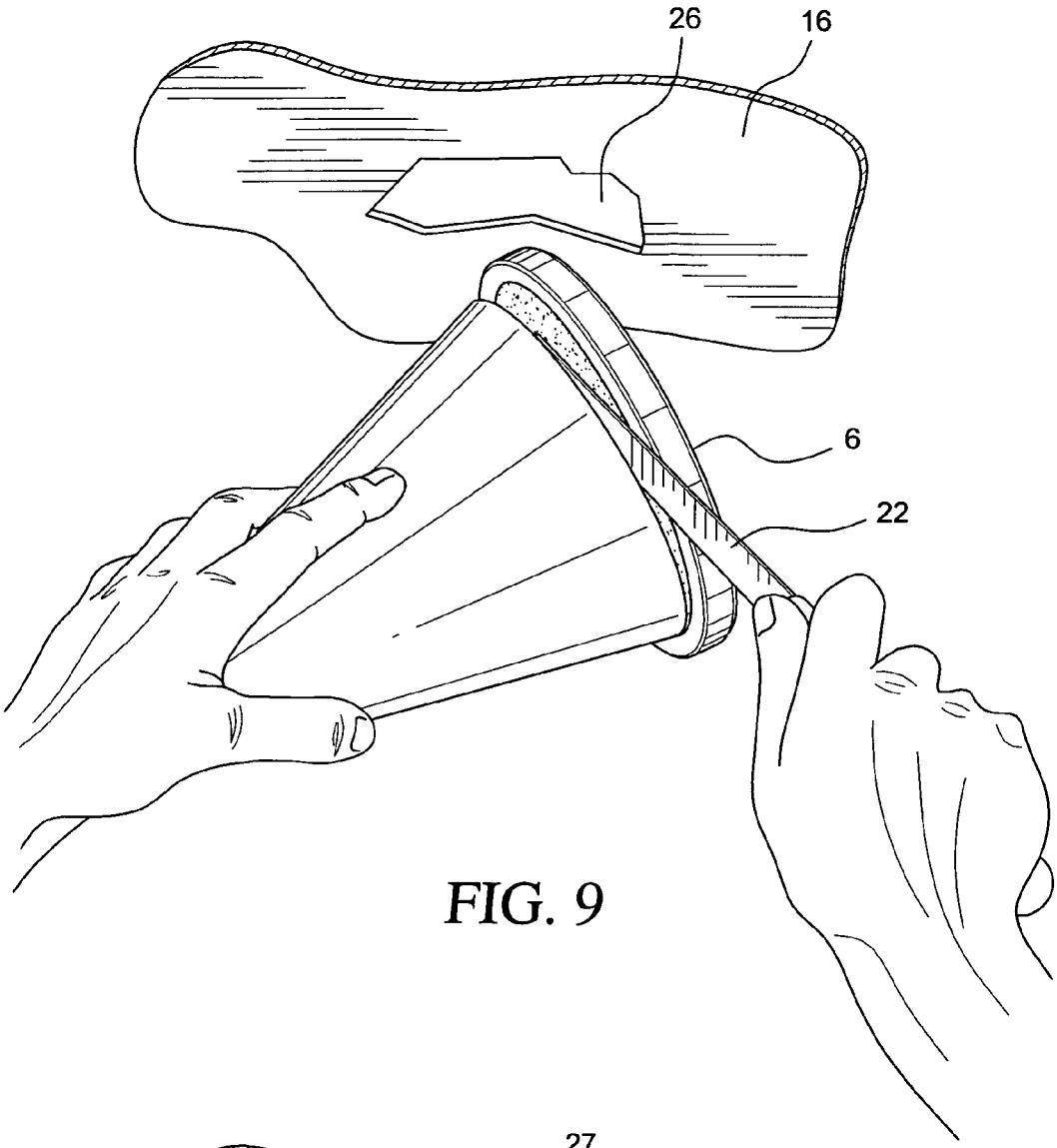
FIG. 9 shows the base flange of the plug of FIG. 1 being cut from the conical body for use in an opening.
Figure 10:
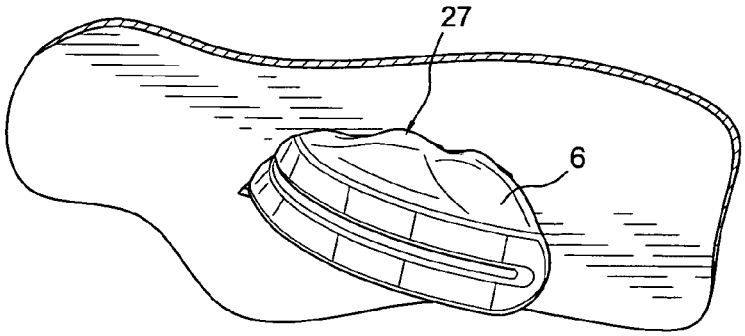
FIG. 10 shows the cut base flange of FIG. 9 folded in half and inserted into the opening.
Figure 11:
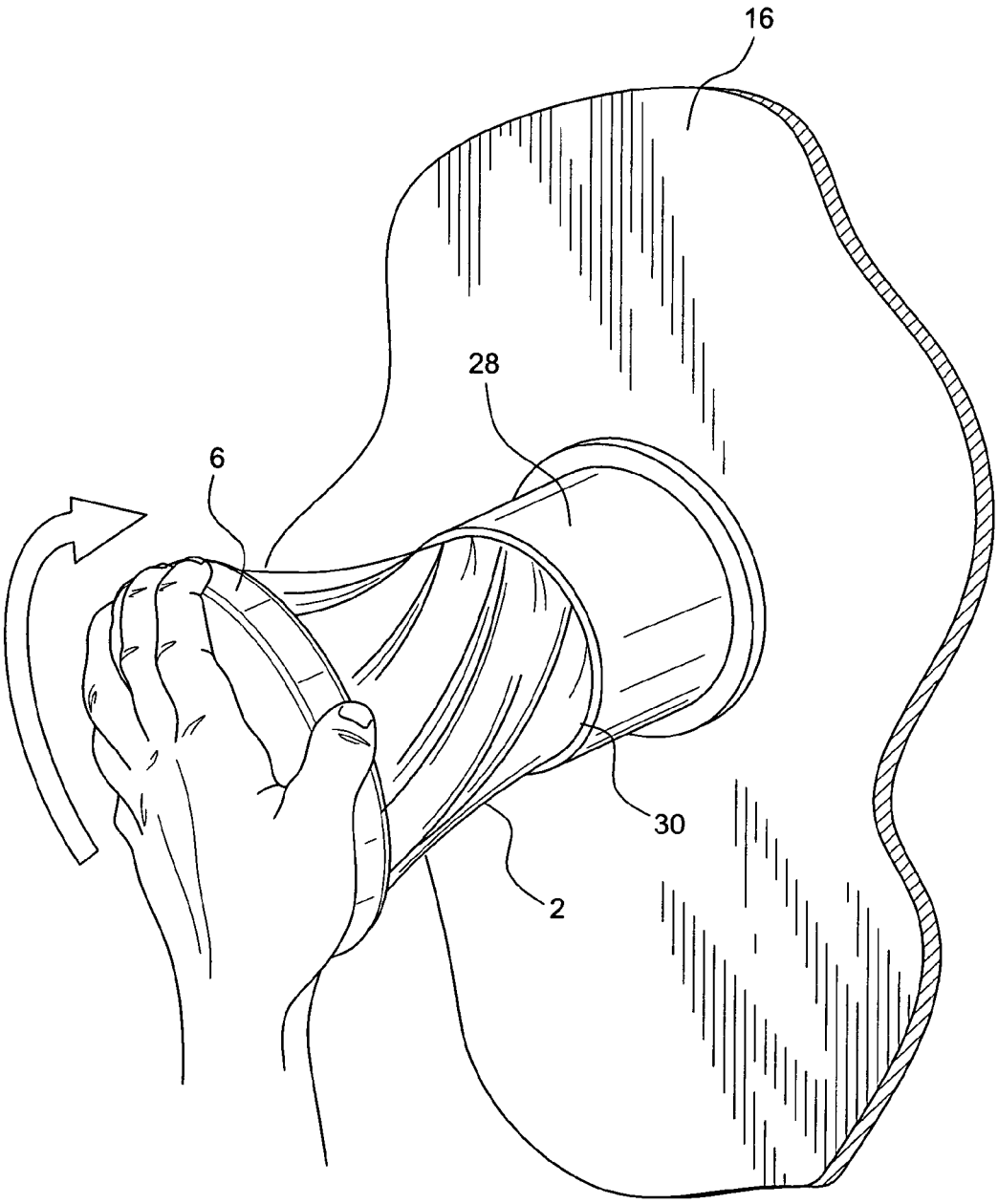
FIG. 11 shows the plug of FIG. 1 being inserted into a through-fitting by twisting by hand.

In another example and referring to FIGS. 9 and 10, the flange 6 may be cut with the knife 22 for a smaller, generally rectangular shaped opening 26 in the hull 16. The cut flange 6 may be folded in half and then compressed for insertion into the opening 26. Similarly to FIG. 6, portions of the cut flange 6 extending outside the opening will form shoulders 27 beyond the periphery of the opening to press against the hull 16, thereby wedging or locking the cut flange 6 in place.

To plug a through-fitting 28 in the hull 16, the plug 2 is inserted and twisted by hand into the opening 30 of the fitting. Due to the compressibility of the plug 2 and its ability to spring back to its original shape, a portion of the conical body 4 within the through-fitting 28 will grab the inside surface of the fitting, thereby holding the plug 2 in place. If enough of the body 4 is protruding from the fitting on the other side of the hull 16 (not shown), that part of the body 4 that is in the water will swell (by returning to its original shape) and be held in place. The base flange 6 advantageously provides a handle portion for a user's hand for twisting and pushing the plug 2 into the opening 30. The plug 2 will compress as it is forced into the opening 30 until it is completely wedged in.

As described above, the plug 2 is compressed by hand and inserted into the breach, either directly into the hull or into the fitting. Since the plug 2 is compressible by hand, it will fit several size openings. The plug 2 will also not require a pressure fit like a wood plug would need. The plug 2 will take the shape of the hole without causing additional damage. The plug 2 can slow the inward flow of water due to a hull breach due to accidental impact which causes a hole or fracture in the hull. If the opening is splintered, the plug 2, due to its compressibility, can be forced into the splintered section of the hull.

The plug 2 is an extremely versatile tool for emergency use. The plug 2 fits a variety of sizes and is inserted by hand. There is also minimum risk of damage to the fitting as the plug 2 takes the shape of the fitting.

If the entire through-hull fitting is torn from the hull, the plug 2 can slow the inward flow of water by taking the shape of the hole in the hull, even if the hole is not round. Designed to be used completely by hand, generally no other tools or parts needed are needed to install the plug 2. The plug 2 can be used on a splintered hull as the foam from which the plug 2 is made is dense enough to allow wood or fiberglass to cut into the foam while still holding its shape and limiting the inward flow of water.

The plug 2 can be forced into a hull breach that has resulted in a large splintered fracture. The plug 2 is forced into the fracture using a blunt tool, such as spatula. The splinters and rough edge of the opening would cut into the plug 2, holding the plug 2 in place to slow the inward flow of water.

The plug 2 can be inserted into any through-hull fitting, valve, or nipple without the possibility of splitting the through-hull fitting, valve, or nipple as a typical wood plug will if inserted with the force necessary to stop the inward flow of water. The plug 2 will not split or break through-hull fittings, valves, or nipples the way tapered wood plugs will.

The plug 2 can also be plugged into hoses. The plug 2 can be partly inserted into the hose, turning and compressing by hand while being inserted. For larger hoses, the plug 2 is forced into the hose, after which the hose is pinched with a clamp to lock the plug 2 in place.

The plug 2 advantageously floats in water and can be easily found in a flooded engine room.

Although the plug 2 has been described in connection with plugging holes in a boat hull, the plug 2 can also be used for temporary plugging of holding tanks during repair.

While this invention has been described as having preferred design, it is understood that it is capable of further modification, uses and/or adaptations following in general the principle of the invention and including such departures from the present disclosure as come within known or customary practice in the art to which the invention pertains, and as may be applied to the essential features set forth, and fall within the scope of the invention or the limits of the appended claims.

We claim:

1. An emergency repair plug for sealing an opening in a boat hull, comprising:

a) a conical body made of a solid foam, spongy cellular material that is compressible by hand and able to return to its original shape, said body having an increasing cross-sectional area from a top portion to a bottom portion of said conical body along its length to accommodate different sizes of the opening;

b) said conical body being compressible by hand to a smaller dimension so that a portion of said conical body larger than an opening to be plugged can be inserted into the opening; and c) said conical body being able to return to its larger size after compression, thereby to be wedged in the opening to slow down water inflow through the opening.

2. An emergency repair plug as in claim 1, wherein said body includes a base flange.

3. An emergency repair plug as in claim 2, wherein said base flange is circular.

4. An emergency repair plug as in claim 2, wherein said base flange includes a peripheral portion extending beyond said conical body.

5. An emergency repair plug as in claim 1, wherein said body includes a coating of sealer.

6. An emergency repair plug as in claim 5, wherein said coating is made by weight of about 30% organic pigment, about 50% resin, about 10% additive and about 10% stabilizer.

7. An emergency repair plug as in claim 1, wherein said body is floatable in water.

8. An emergency repair plug as in claim 1, wherein said body is made of polyurethane.

9. An emergency repair plug as in claim 8, wherein said polyurethane is made by weight of about 60% polyether, about 31% MDI (methylene diphenyl diisocyanate and about 9% colorants.

10. A method for temporarily plugging an opening to stop water flow through the opening, comprising:

a) providing a conical shaped body made of hand-compressible solid foam, spongy material, the body having an increasing cross-sectional area from a top portion to a bottom portion of the conical body along its length;

b) compressing a portion of the conical body into a size small enough to fit in an opening to be plugged;

c) inserting the compressed portion into the opening; and d) releasing the compressed portion within the opening, thereby allowing the compressed portion to be wedged in the opening to slow down water inflow through the opening.

11. A method as in claim 10, and further comprising the step of cutting the body to a size appropriate for the opening.

12. A method as in claim 11, wherein said body is cut lengthwise.

13. A method as in claim 11, wherein said body is cut cross-wise.

* * * * *